US005857710A

United States Patent [19]

Leising et al.

[11] Patent Number: 5,857,710

[45] Date of Patent: Jan. 12, 1999

[54] MULTI-CYCLE RELEASABLE CONNECTION

[75] Inventors: Larry J. Leising, Sugar Land; Howard L. McGill, Lufkin, both of Tex.

[73] Assignee: Schlumberger Technology Corporation, Sugar Land, Tex.

[21] Appl. No.: 743,275

[22] Filed: Nov. 4, 1996

[51] Int. Cl.[6] ..... F21B 43/116

[52] U.S. Cl. ..... 285/3; 166/178; 175/321; 175/301

[58] Field of Search ..... 285/3, 18; 175/321, 175/301; 166/178, 377

[56] References Cited

U.S. PATENT DOCUMENTS

| | | | |
|---|---|---|---|
| 1,214,622 | 2/1917 | Walker | 175/301 |
| 2,029,609 | 2/1936 | Burns et al. | 175/301 |
| 2,819,876 | 1/1958 | Ransom | 175/301 |
| 4,113,038 | 9/1978 | Clark | 175/321 |
| 4,256,179 | 3/1981 | Shillander | 175/321 |
| 4,576,229 | 3/1986 | Bown | 175/321 |
| 4,665,998 | 5/1987 | Burton | 166/178 |
| 5,086,844 | 2/1992 | Mims et al. . | |
| 5,257,663 | 11/1993 | Pringle et al. . | |
| 5,323,853 | 6/1994 | Leismer et al. . | |
| 5,361,834 | 11/1994 | Cox . | |
| 5,363,921 | 11/1994 | Mendez . | |
| 5,392,881 | 2/1995 | Arend . | |
| 5,394,951 | 3/1995 | Pringle et al. . | |
| 5,419,399 | 5/1995 | Smith . | |
| 5,423,382 | 6/1995 | Barton et al. . | |
| 5,443,120 | 8/1995 | Bailey et al. . | |
| 5,452,923 | 9/1995 | Smith . | |
| 5,470,118 | 11/1995 | Burton | 294/86.18 |
| 5,669,458 | 9/1997 | Anders | 166/178 |

FOREIGN PATENT DOCUMENTS

0624709A2 11/1994 European Pat. Off. .

*Primary Examiner*—Eric K. Nicholson
*Attorney, Agent, or Firm*—Bush, Riddle & Jackson

[57] ABSTRACT

A releasable connection between the lower end of a running string and a well tool that is subject to being stuck in a well includes inner and outer members movable telescopically between contracted and extended positions, a tension sleeve connecting the members in the contracted position and being disrupted by a predetermined pull to allow telescoping movement, a stop nut to limit such movement in the extended position of the members, and a mechanism responsive to a certain number of cycles of telescoping movement for disabling the stop nut to allow complete release and separation of the members.

17 Claims, 2 Drawing Sheets

MULTI-CYCLE RELEASABLE CONNECTION

FIELD OF THE INVENTION

This invention relates generally to a selectively releasable connection or safety joint for use in disconnecting the running string from a well tool that is stuck in a well, and particularly to a releasable connection that allows a much greater pulling force to be applied by the string to the stuck tool in an effort to dislodge the tool than the force that triggers the operation of the releasable connection.

BACKGROUND OF THE INVENTION

There are numerous circumstances where it is prudent to provide a releasable connection or coupling between the lower end of a running string of pipe or tubing and a tool suspended thereon that allows the running string to be recovered in the event that the tool gets stuck. For example when a downhole drilling motor is run on coiled tubing to drill a bore that is deviated substantially from the vertical, the possibility that the motor and its bit may get stuck is greatly enhanced. A release of the lower end of the coiled tubing is made more problematical by the fact that the tubing is continuous throughout its length, and thus has no joints that can be unthreaded. Moreover it can not be turned because it is wound on a large storage reel at the surface. Of course it will be recognized that a downhole tool is considered stuck when the operator pulls up on the running string to the allowable limit but the tool does not move upward, even though a greater pull might have dislodged the tool.

Various releasable devices of the type described above have been proposed, but have certain shortcomings. Some require that a ball be circulated down into a seat so that pressure can be applied to shear pins and trigger a release. However it is fairly common to employ an armored electric cable in the running string to provide a telemetry link with a downhole sensor package, so that a ball can not be used. Passage of the ball through the tubing with internal wireline is not always assured. Other devices have used a tension sleeve instead of shear pins, however the limitation of not being able to apply pulling force to the stuck tool once the sleeve fails remains as a significant drawback.

An object of the present invention is to provide a new and improved releasable connection apparatus that obviates the problems and shortcomings with prior devices.

Another object of the present invention is to provide a new and improved, releasable connection apparatus that operates to allow high pulling forces to be applied to a stuck well tool after the release mechanism has been triggered by tension in the running string.

SUMMARY OF THE INVENTION

The above as well as other objects are attained in accordance with this invention through the provision of a selectively releasable connection apparatus that includes an inner tubular member attached to the running string and slidably disposed within the bore of an outer tubular member that is attached to a well tool such as a drilling motor that has become stuck in a well bore. Splines prevent relative rotation of the members, and a weak point for tensile loads normally prevents relative longitudinal movement so that the members remain retracted. After the weak point is disrupted by tension in the running string, the inner member extends. However, a stop nut prevents complete disengagement of the inner member so that substantially higher pulling loads can be applied to the stuck tool than that which was necessary to break the weak point. If the tool cannot be dislodged even by the higher loads, then the connection can be fully released in response to a certain number of cycles of telescoping movements of said inner member relative to said outer member. Such movements disable the stop nut which allows the inner member to be separated from the outer member. After a lesser number of such cycles, a positive indication is given at the surface that release of the connection is imminent. When complete release is attained, the running string can be removed intact from the well so that other fishing operations can be undertaken to dislodge and recover the stuck tools. The present invention is particularly applicable where tools such as mud motors are run on coiled tubing.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
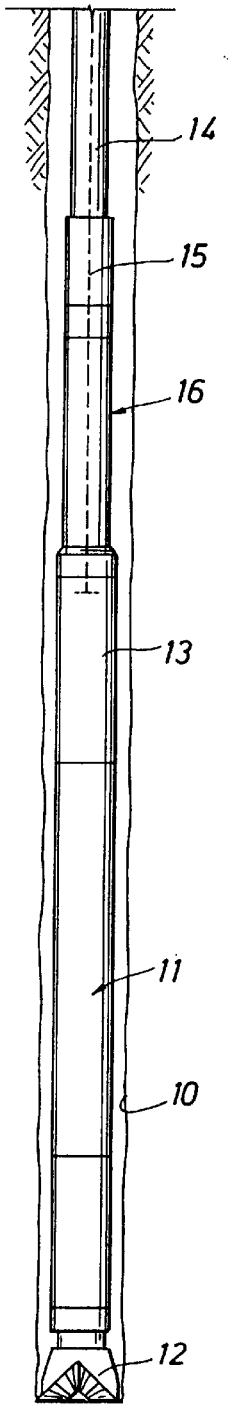
FIG. 1 is a schematic view of a series of well tools that is used to drill a borehole into the earth.

Referring initially to FIG. 1, a well bore 10 is shown being drilled by a downhole drilling motor 11 that rotates a drill bit 12. The motor 11 preferably is a positive displacement device having a lobed rotor that turns within a lobed stator in response to the circulation of drilling mud under pressure. A drive shaft with universal joints connects the rotor to the bit 12. In the case of a directional well the housing of the motor 11 typically is formed with a bend angle that causes the bit 12 to drill along a curved trajectory. Although the borehole 10 is shown as vertical in FIG. 1, it will be recognized that it can extend at a very high angle to the vertical, and even substantially horizontal.

A sensor package 13 can be connected to the upper end of the motor 11 and house various components by which the inclination and azimuth of the borehole 10 can be measured, as well as various other parameters and characteristics of interest. The tools are run on a length of continuous coiled tubing 14 that is wound off of and onto the large storage reel of a unit (not shown) that is parked near the well at the surface. The coiled tubing 14 is fed to an injector which drives the tubing into the well under pressure through a blowout preventer and a stripper. A typical connection 15 on the lower end of the coiled tubing 14 attaches the same to the upper end of a releasable connection apparatus 16 which is constructed in accordance with the present invention. The lower end of the apparatus 16 is attached to the top of the sensor package 13. Alternatively the sensor package 13 could be located above the connection apparatus 16. Typically an electric wireline in the form of an armored cable, shown in dotted lines, extends throughout the bore of the coil tubing 14, the connector 15 and the apparatus 16 in order to electrically connect the sensor package 13 to surface instrumentation and read-out devices.

Figure 2A:
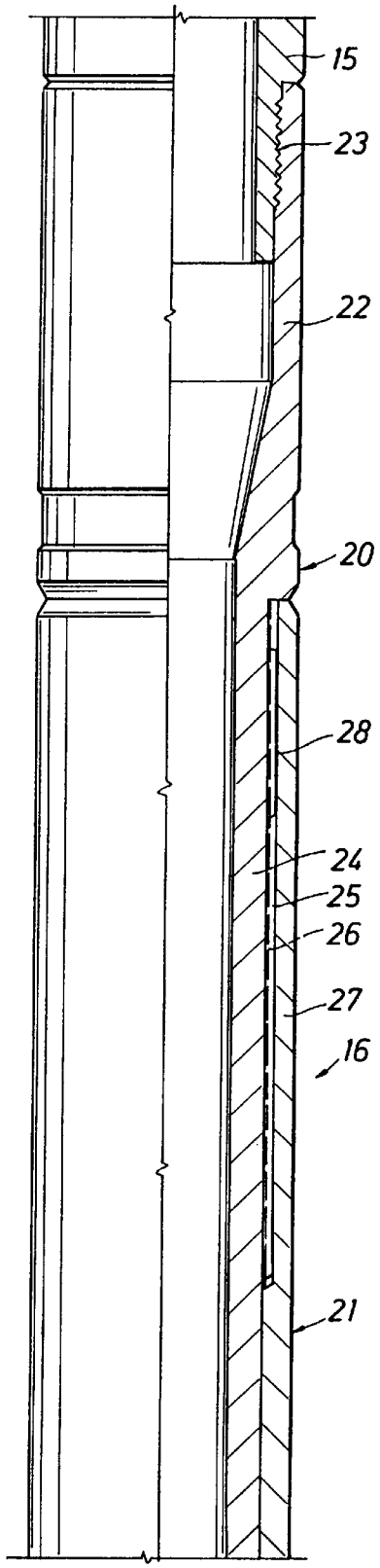
FIG. 2A–2C are longitudinal section views, with portions in side elevation, showing the releasable connection apparatus of the present invention.
Figure 2B:
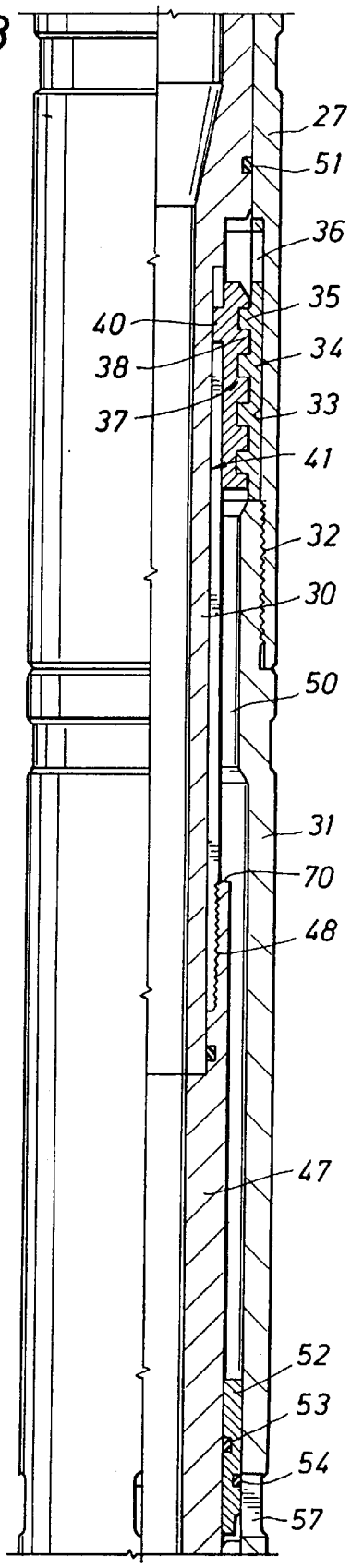
Figure 2C:
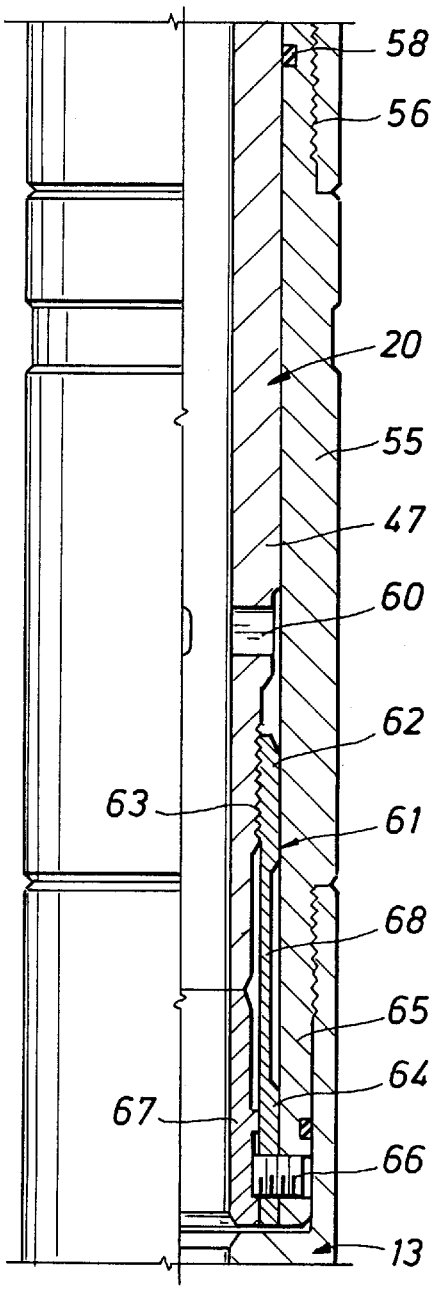

As illustrated in FIGS. 2A–2C, the releasable connection apparatus 16 includes an elongated, generally tubular mandrel 20 that extends down inside the bore of a tubular housing 21. The upper section 22 of the mandrel 20 is threaded at 23 for reception of a typical coiled tubing "dimple" connection 15 which rigidly fixes the mandrel to the lower end of the coiled tubing 14. The next portion 24 of the mandrel 20 is reduced somewhat in diameter and has a plurality of angularly spaced splines 25 that mesh with companion internal spline grooves 26 in the upper portion 27 of the housing 21 to prevent relative rotation. The grooves 26 open through the top end of the housing 21 so that the mandrel 20 can be lifted out of the housing when released to do so as described below. An internal annular recess 28 provides a means of coupling a standard fishing tool to the housing 21 once the mandrel 20 is removed.

The next lower portion 30 (FIG. 2B) of the mandrel 20 is further reduced in outer diameter and extends down inside a housing section 31 that is threaded to the housing portion 27 at 32. An internal annular recess 33 receives a female nut member 34 having large, square threads 35 on its inner periphery. The female nut member 34 is prevented from rotating in the recess 33 by projections 36 on its upper end which fit in slots on the housing portion 27.

Figure 3:
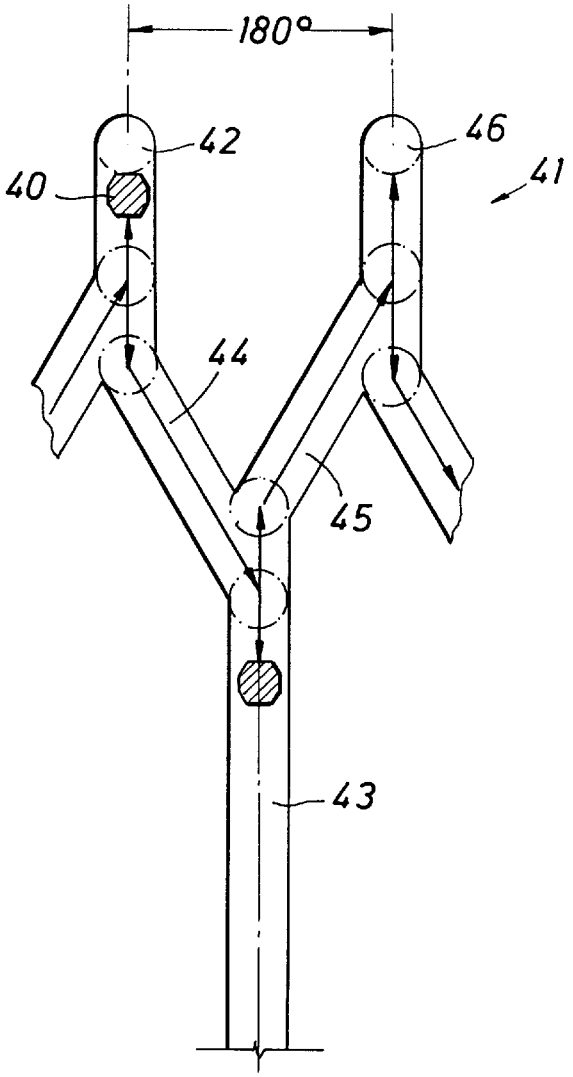
FIG. 3 is a developed plan view of a slot system used in release of the connection apparatus of FIG. 2.

Mounted inside the female nut 34 is a male stop nut 37 having large threads 38 on its exterior which mesh with the female threads 35. A lug 40 on the inside of the stop nut 37 projects into a slot or channel system indicated generally at 41 and formed in the outer periphery of the mandrel portion 30. The slot system 41, which is shown in developed plan view in FIG. 3, includes an upper pocket 42 that extends axially downward and is connected to a lower axial slot 43 by an inclined slot 44. The upper end of the axial slot 43 is connected by another inclined slot 45 to another upper pocket 46 that is diametrically opposed to the pocket 42. Additional slots like 43, 44 and 45 are formed on the opposite side of the mandrel portion 30 so that the system of slots is continuous, as shown. Thus the lug 40 and the male stop nut 37 are driven in increments of rotation in the same rotational direction when the mandrel 20 is reciprocated within the bore of the housing 21. If desired, a pair of lugs 40 and a pair of slots 43 may be utilized.

The lower end of the mandrel portion 30 is threaded at 48 to the upper end of a lower mandrel portion 47. An annular chamber 50 is formed between outer surfaces of the mandrel portions 30 and 47 and the adjacent inner walls of the housing portions 27 and 31. The upper end of the chamber 50 is closed by a seal ring 51, and the lower end of the chamber is closed by an annular compensating piston 52 that carries inner and outer seal rings 53, 54. The chamber 50 is filled with grease to ensure smooth working of the male stop nut 37 and the lug 40 in the slot system 41.

The housing section 31 is threaded to a lower housing section 55 at 56, and a plurality of circulation ports 57 open through the wall of the section 31 at the upper end of the section 55. Such upper end limits downward movement of the compensating piston 52, and seal rings 58 prevent fluid leakage between the section 55 and the lower portion 47 of the mandrel 20 so long as the mandrel is telescoped downward as shows However, when the mandrel 20 is permitted to move sufficiently upward, circulation ports 60 in the mandrel section 47 are disposed above the seal rings 58 on the housing section 55 so that drilling fluids can flow to the outside of the apparatus.

To prevent any upward relative movement of the mandrel 20 unless and until a selected load is taken thereon by pulling up on the coiled tubing 14 at the surface, a weak point sleeve 61 (FIG. 2C) has its enlarged diameter upper end 62 attached to the lower end portion 47 of the mandrel 20 by threads 63. The lower end portion 64 of the sleeve 61 is attached to the housing portion 65 by a plurality of radial pins 66 that extend through holes in the sleeve 61. The pins 66 also retain an inner guide sleeve 67 by extending into an external annular groove therein. The portion 65 is attached to the sensor package 13 by threaded and sealed connection as shown.

The central portion 68 of the weak point sleeve 61 has a reduced diameter, as shown, to provide a weakened cross-section that can be pulled into a selected tension, for example about 10,000 lbs. Once the sleeve 61 breaks, the mandrel 20 can be elevated, initially, until the upper end surface 70 (FIG. 2B) of the mandrel section 47 engages the bottom of the male stop nut 37. Each time the mandrel 20 is made to undergo a cycle of upward and downward movements by manipulation of the coil tubing 14 at the surface, the male stop nut 37 is progressively turned and thereby threaded upward through the female nut 34. The position at which the stop nut 37 is engaged by the shoulder 70 advances gradually upward during each cycle upward and downward telescoping movements. The parts are sized and arranged such that where the male stop nut 37 is nearing total disengagement, the circulation ports 60 and 57 begin to communicate with one another when the mandrel 20 is raised and the coiled tubing 14 is in tension.

OPERATION

In the operation and use of the present invention, the releasable connection apparatus 16 is assembled and dressed as shown in the drawings and described above, with the mandrel 20 being in its lowest position relative to the housing 21, and being retained in such position by the weak point sleeve 61. The splines 25, 26 prevent relative rotation, and the male stop nut 37 is fully meshed with the female nut 34. The lug 40 extends into one of the upper pockets 42 or 46 of the slot system 41. The apparatus 16 is connected in between the dimple connector 15 and the sensor package 13, and the drilling tool string is run into the well on the lower end of the coiled tubing 14.

Should the downhole motor 11 and drill bit 12 become stuck in the borehole, a load as high as 10,000 lbs. can be taken on the coiled tubing 14 in an effort to dislodge the tools without triggering the apparatus 16. If that effort is unsuccessful, a pulling force of 10,000 lbs. will disrupt the weak point sleeve 61 at its weakened region 68 and allow the mandrel 20 to be pulled upward until the shoulder surface 70 engages the male stop nut 37. The nut 37 is unthreaded by ¼ turn as the lug 40 moves into the axial slot 43, however ample engagement of the stop nut with the female nut 34 remains. Thus much larger strains can be taken in the coil tubing 14 in an effort to dislodge the drilling tools, for example as much as 50,000 lbs. Where this is not successful, cycles of up and down movements are applied to the mandrel 20 by picking up and slacking off on the coiled tubing 14 at the surface to release the apparatus 16. For example a total of seven of such cycles is required to release the exemplary embodiment.

Initially, the mandrel 20 can not be moved upward enough for the circulation ports 60 to clear the seal rings 58. Thus circulation to the outside can not as yet be established. However at the end of four of such cycles, the male stop nut 37 will permit the mandrel 20 to move upward enough that the circulation ports 60 and 57 are in communication. When this occurs there is a drop in pump pressure at the surface which provides a positive surface indication or signal that the apparatus 16 is about to release. After an additional three cycles the stop nut 37 disengages from the female nut 34 so that the mandrel 20 is released completely from the housing 21. Then the coiled tubing 14 and the wireline electric cable 15 therein can be withdrawn from the well with the mandrel 20 and its associated parts on the lower end of the tubing.

Where further efforts are to be made to dislodge and retrieve the drilling tool string, a typical fishing tool can be run in and connected to the recess 28 in the upper end of the housing 21. Once both the mandrel and housing assemblies of the present invention has been recovered, the tool 16 can be redressed for further use by replacing the weak point sleeve 61, and redressing the chamber 50.

It now will be recognized that a new and improved releasable connection apparatus has been disclosed which is simple and reliable in operation, and allows high pulling forces to be applied to the fish even after the apparatus is triggered at a lower force. Since certain changes and modifications may be made in the disclosed embodiment without departing from the inventive concepts involved, it is the aim of the appended claims to cover all such changes and modifications falling within the true spirit and scope of the present invention.

What is claimed is:

1. Apparatus for use in releasably connecting a running string to a well tool in a manner such that the running string can be retrieved from a well in case the well tool becomes stuck therein comprising: a pair of tubular telescoping members, one of said members being attached to the running string and the other of said members being attached to the well tool; releasable means preventing telescoping movement of said members until a predetermined level of force is applied to said one member; limiting means for limiting the extent of said telescoping movement after release of said releasable means by application of said force; and disabling means responsive to a plurality of cycles of up and down telescoping movements of said running string for disabling said limiting means and thereby allowing separation of said members.

2. The apparatus of claim 1 wherein said disabling means include cooperating cam and follower means operatively connected between said telescoping members to provide rotative movement of said disabling means with each cycle of telescoping movement resulting in successive incremental rotative steps of said disabling means for disabling said limiting means to permit separation of said members.

3. The apparatus of claim 1 wherein said releasable means includes an element connected between said members and having a weakened region designed to break when subjected to said level of force.

4. The apparatus of claim 1 wherein said limiting means includes a shoulder on said one member and a stop nut threaded on said other member that is engaged by said shoulder to limit telescoping movement.

5. The apparatus of claim 4 wherein said disabling means includes means responsive to said telescoping movement for rotating said stop nut to unthread it from said other member.

6. The apparatus of claim 5 wherein said rotating means includes continuous slot means on said one member cooperable with follower means on said nut so that telescoping movement of said one member causes rotation of said nut in a direction to unthread the same.

7. The apparatus of claim 1 further including normally closed circulation port means in said members; and means for opening said port means after a selected number of said telescoping movements.

8. Apparatus for use in releasably connecting a running string to a well tool in a manner such that the running string can be retrieved from a well in case the well tool becomes stuck therein, comprising: an outer tubular member adapted to be attached to the well tool; an inner tubular member telescopically disposed in said outer member for movement between retracted and extended positions; releasable means for holding said members in said retracted position unless a predetermined level of axial load is applied to said inner member by the running string; stop means operable upon release of said releasable holding means for limiting extension of said inner member relative to said outer member; and disabling means responsive to a plurality of cycles of up and down telescoping movements of said inner member within said outer member for disabling said stop means so that said inner member can be withdrawn from said outer member and separated therefrom.

9. The apparatus of claim 8 further including slidable spline means on said members for preventing relative rotation therebetween.

10. The apparatus of claim 8 wherein said releasable holding means includes a tension sleeve coupled between said members in said retracted position and having a weakened section that is disrupted by said predetermined level of axial load.

11. The apparatus of claim 8 wherein said stop means includes nut means on said outer member, and a shoulder on said inner member adapted to engage said nut means when said inner member telescopes to said extended position.

12. The apparatus of claim 11 wherein said disabling means includes cam means on said inner member cooperable with follower means on said nut means for causing rotation of said nut means during each of said cycles of telescoping movements of said inner member.

13. The apparatus of claim 12 wherein said nut means includes a female nut fixed to said outer member and having internal threads, and a male nut carrying said follower means and having external threads meshed with said internal threads, said shoulder being sized and arranged to pass through said female nut when said male nut is unthreaded therefrom.

14. The apparatus of claim 13 wherein said cam means includes a system of interconnected axial and inclined slots that cause said follower means and male nut member to undergo unidirectional rotation through a selected angle during each of said cycles of telescoping movement.

15. The apparatus of claim 3 further including normally closed circulation port means in said members; and means operable during disabling of said stop means for opening said circulation port means during extension of said inner member.

16. The apparatus of claim 8 further including recess means in said outer member to permit a fishing tool to be connected thereto after withdrawal of said inner member.

17. The apparatus of claim 8 wherein said disabling means includes cooperating cam and follower means operatively connected between said inner member and said outer member effective to provide successive rotative increments of said disabling means resulting from said cycles of telescoping movements for disabling of said stop means.

* * * * *